United States Patent [19]

Nakamura et al.

[11] 4,371,479

[45] Feb. 1, 1983

[54] VARIABLE VENTURI CARBURETOR

[75] Inventors: Norihiko Nakamura; Takashi Kato, both of Mishima, Japan

[73] Assignee: Toyota Jidosha Kogyo Kabushiki Kaisha, Toyota, Japan

[21] Appl. No.: 304,914

[22] Filed: Sep. 23, 1981

[30] Foreign Application Priority Data

Oct. 7, 1980 [JP] Japan ..... 55-139332

[51] Int. Cl.[3] ..... F02M 9/06

[52] U.S. Cl. ..... 261/44 C; 261/DIG. 38; 261/121 B; 251/DIG. 4

[58] Field of Search ..... 261/44 C, DIG. 38, 121 B; 251/DIG. 4

[56] References Cited

U.S. PATENT DOCUMENTS

| | | | |
|---|---|---|---|
| 2,118,947 | 5/1938 | Schimanek | 261/44 C |
| 3,653,642 | 4/1972 | Lawrence | 261/44 C |
| 4,267,128 | 5/1981 | Kobayashi et al. | 261/44 C |
| 4,302,404 | 11/1981 | Nakamura et al. | 261/44 C |

FOREIGN PATENT DOCUMENTS

| | | | |
|---|---|---|---|
| 691414 | 10/1930 | France | 261/44 C |
| 231118 | 2/1944 | Switzerland | 261/44 C |
| 708585 | 5/1954 | United Kingdom | 261/44 C |

*Primary Examiner*—Tim R. Miles

*Attorney, Agent, or Firm*—Finnegan, Henderson, Farabow, Garrett & Dunner

[57] ABSTRACT

A variable venturi carburetor in which a biasing spring urges a metering needle to contact the metering jet during low air-intake operating conditions and including an expanded portion formed at the front end of the metering needle which is loosely contained in a large bore portion of a well during low air-intake operating conditions and which engages a small bore portion of the well during high air intake operating conditions to center the metering needle in the metering jet for maintaining bleed sensitivity constant while the amount of bleed air varies.

9 Claims, 6 Drawing Figures

CIRCUIT FOR PROCESSING ANGLE MODULATED BROADCAST SIGNALS

BACKGROUND OF INVENTION

The present invention relates to receivers for demodulating angle modulated broadcast signals. Specifically, a circuit for processing angle modulated waves from a broadcast signal also containing amplitude modulation components is provided.

Recently there have been proposed systems for generating stereophonic broadcast signals in the low frequency radio spectrum currently authorized for amplitude modulation broadcasts. In one system proposed by the Magnavox Consumer Electronics Company, as set forth in FCC docket 21313, In the Matter of AM Stereophonic Broadcasting; hereby incorporated by reference, two stereophonically related signals R (t) and L (t) are summed together to form a summation signal. The summation signal modulates the amplitude of the broadcast signal comprising a monophonic broadcast received by listeners having radio receivers of conventional design. The stereophonic related signals are also subtractively combined to provide a difference signal L (t)-R (t). The difference signal is used to linearly phase modulate the broadcast carrier. Receivers of conventional design are transparent to the linear phase modulation, and are not effected by the presence of the difference signal. However, receivers which have a linear phase demodulator for demodulating the phase excursions of the intermediate frequency signal produced in a broadcast radio receiver will derive the L−R information which when combined with the AM detected L+R information will generate stereophonically related signals which may be amplified and applied to separate speakers.

Some difficulty in demodulating a stereophonic signal in accordance with the above has been found in that large negative amplitude modulation peaks, those exceeding 95%, result in a temporary loss of signal to the phase demodulator. During the time that no input signal is supplied to the phase demodulator, there can be a generation of noise in that the phase demodulator attempts to detect the phase content of noise which appears at the input during periods when a loss of intermediate frequency signals is experienced. The noise bursts which occur under these high amplitude modulation conditions can be objectionable to a listener and in general will impair the quality of stereophonic reception available in the low frequency broadcast band.

SUMMARY OF INVENTION

It is an object of this invention to continuously provide an intermediate frequency signal to an angle demodulator means.

It is a further object of this invention to maintain a signal to a phase demodulator of a stereophonic receiver during periods when a broadcast signal is temporarily below a minimum amplitude.

These and other objects are accomplished by a circuit in accordance with the invention which maintains an input signal to a limiter used to limit amplitude excursions of a signal to be angle demodulated. Means for detecting a temporary loss in signal to said limiter are provided to detect a loss of signal which results from large negative amplitude modulation on an angle modulated wave, such as is produced in the aforementioned AM stereophonic broadcasting system as proposed by the Magnavox Consumer Electronics Company. When excessive negative amplitude modulation is present on a carrier signal, a loss of intermediate frequency signal occurs. The present invention provides a substitute intermediate frequency signal upon the detection of a loss in broadcast signal or its corresponding intermediate frequency signal, or when the amplitude of the broadcast signal drops below a predetermined minimum.

In a preferred embodiment of the invention, the substitute signal is generated by applying a feedback signal to an amplifier which supplies the intermediate frequency signal to a limiter during a condition of high negative amplitude modulation of a broadcast signal, During the time that negative modulation peaks exceed a predetermined minimum, the amplifier circuit is forced into oscillation at substantially the intermediate frequency and a subsequent angle demodulator which may be a frequency discriminator, or phase demodulator, is supplied with the oscillating signal. During the demodulation of a broadcast signal, the angle demodulator is at all times supplied with a signal at substantially the intermediate frequency of the receiver. Therefore, the generation of noise inherent in angle demodulator receivers in response to a loss of broadcast signal whether temporary or not, is avoided.

DESCRIPTION OF THE PREFERRED EMBODIMENT

Figure 1:
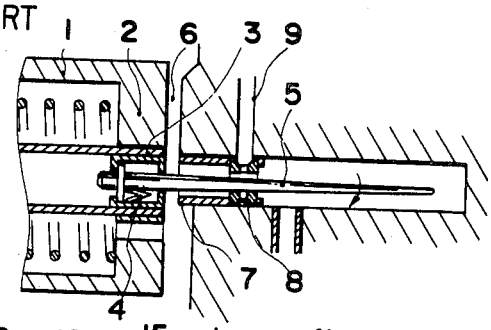
Fig. 1 PRIOR ART
FIG. 1 is a block diagram of one embodiment of apparatus for generating a substitute intermediate frequency signal.

FIG. 1 is a block diagram illustrating apparatus for maintaining an intermediate frequency signal, hereinafter IF signal, to a limiter when the amplitude of a received broadcast signal is below a predetermined minimum. The apparatus contains the familiar elements known to those skilled in the art of a superheterodyne receiver to derive an IF signal. Antenna 5 conveys a broadcast signal to radiofrequency amplifier 6. The output of radiofrequency amplifier 6 is mixed in a known way by mixer 7 with the local oscillator signal provided by local oscillator 8. The resulting intermediate frequency signal is amplified by an I.F. amplifier 10. The intermediate frequency signal is thereafter demodulated by the circuitry of FIG. 1 to provide an L+R signal proportional to amplitude modulation contained in the broadcast signal, and an L−R signal proportional to a phase modulation of the intermediate frequency signal.

Figure 2:
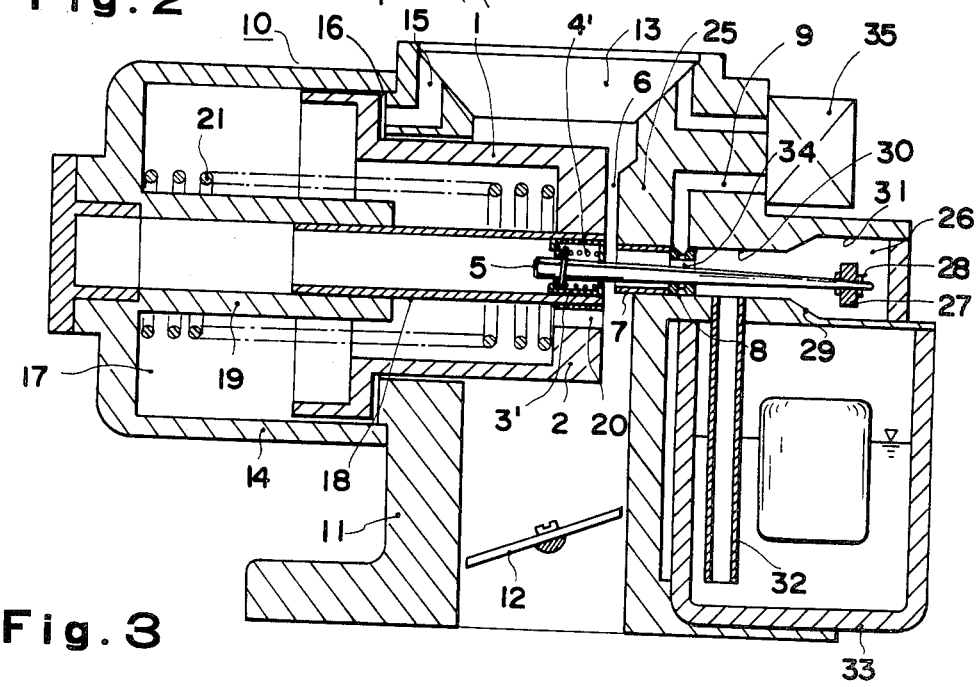
FIG. 2 illustrates circuit waveforms produced in the apparatus of FIG. 1.

Referring to FIG. 2, there is shown an intermediate frequency signal from IF amplifier 10. Because of the high negative amplitude modulation peaks appearing on a broadcast signal received by antenna 5, the intermediate frequency signal goes to zero during a portion of the broadcast signal which has negative modulation peaks in excess of 95%. During this period of time, AM detector 11 provides zero output voltage indicative of the condition of amplitude modulation on the broadcast signal. Amplifier 13 provides the detected output of the AM detector 11 to a matrix means not shown where it is combined with a difference signal to derive left and right stereophonically related signals. During the interval that the condition of the intermediate frequency signal is above a predetermined amplitude, IF switch 16 is closed thereby providing the intermediate frequency signal directly to limiter 21. Limiter 21 limits the amplitude excursions of the input signal in a known way before applying it to a phase detector 22. Phase detector 22 provides a voltage which varies according to the angle modulated components appearing on the wave which in the aforementioned system of stereophonic broadcasting are phase modulation components. Amplifier 24 amplifies the demodulated signal as an L−R signal. The L−R signal is matrixed in a known way with the L+R signal to derive two stereophonically related signals L, and R.

The present invention provides for the substitution of the intermediate frequency signal from IF amplifier 10 with a internally generated intermediate frequency signal. The advantage of such a scheme is to always provide limiter 21 with a signal avoiding a condition whereby phase detector 22 is without an input signal and produces noise in an effort to detect phase modulation in the absent broadcast carrier signal.

The substitute IF signal generated by a locked oscillator 18 which has a frequency predetermined to be the intermediate frequency of a signal from IF amplifier 10. Oscillator 18 is frequency locked to the intermediate frequency signal provided by IF amplifier 10 during closure of switch 16 by means of switch 15 also closed. The oscillator output signal is interrupted by a switch 19 which couples the output signal to limiter 21.

Referring now to FIG. 2, the operation of the apparatus of FIG. 1 may be more completely understood. The IF signal from intermediate frequency amplifier 10 is detected by an AM detector 11. AM detector 11 has an output signal which indicate the relative percentage of negative amplitude modulation present on the incoming broadcast signal. Control circuit 14 detects this level, and when the negative modulation percentage of the input I.F. signal is below a predetermined amount, which the inventor has selected to be 95% in a preferred embodiment, a pulse is produced to switch 15 disconnecting the locked oscillator 18 from intermediate frequency amplifier 10. At the same instant, a control pulse is provided to switch 19 closing the switch, whereby the output of the locked oscillator 18 is supplied to a limiter 21. When the intermediate frequency signal from IF amplifier 10 reaches a minimum level a third control pulse is produced to open switch 16.

The result of the foregoing circuitry is the generation of a substitute IF signal which maintains the phase detector 22 with an input IF signal with a predetermined minimum amplitude. Limiter 21 is always maintained in a limiting condition which reduces noise bursts likely to occur when a limiter 21 loses signal because of a loss in carrier or when the limiter is receiving a signal having an amplitude below an effective level to maintain limiting.

Thus there is described with respect to one embodiment an apparatus for maintaining an intermediate frequency signal for all levels of amplitude modulation which may occur on a broadcast signal.

Figure 3:
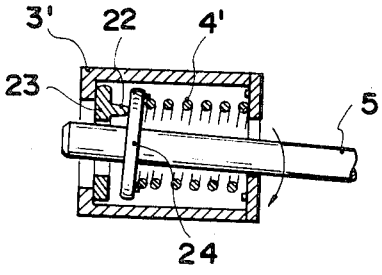
FIG. 3 illustrates a more preferred embodiment of apparatus for generating a substitute intermediate frequency signal.
Figure 4:
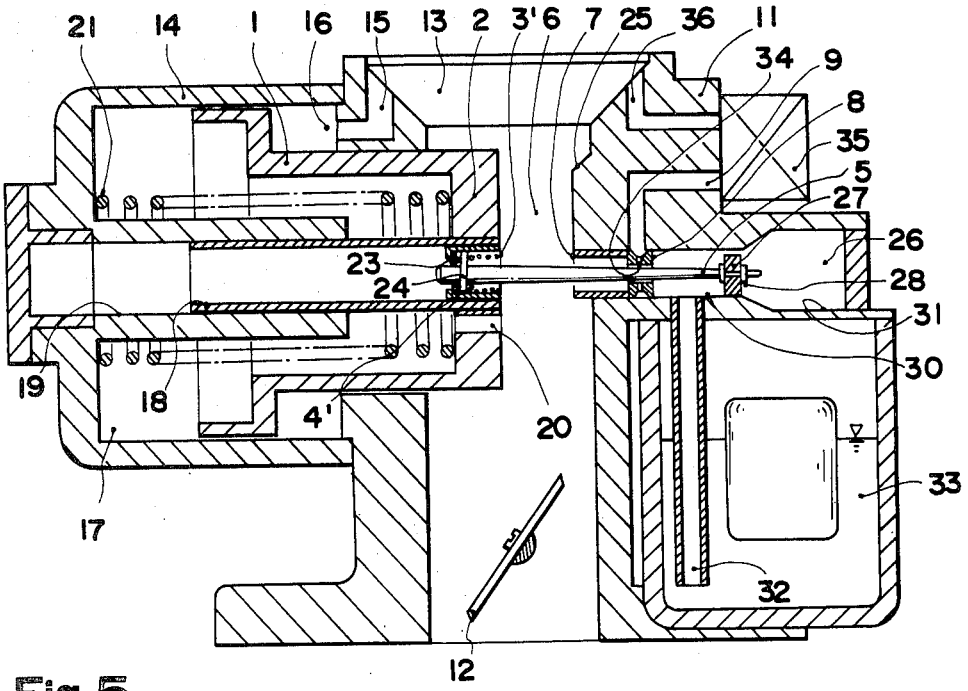
Figure 5:
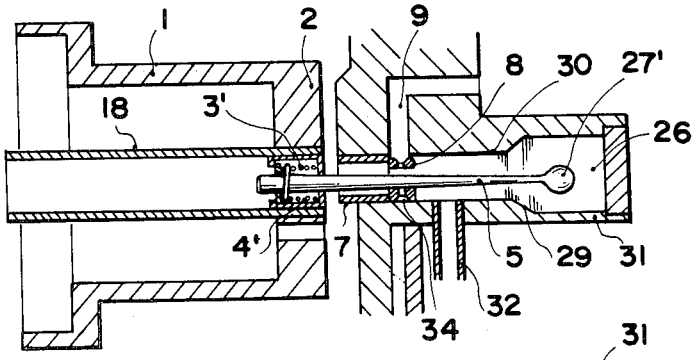
Figure 6:
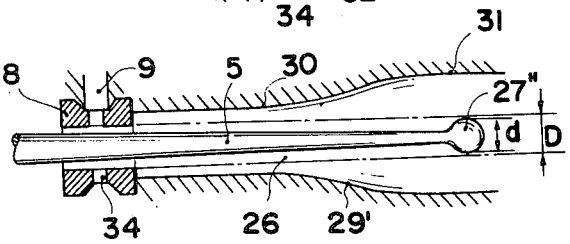

A more preferred embodiment of the invention is shown in FIG. 3. The subject matter of FIG. 3 differs from FIG. 1 in that the substitute intermediate frequency signal is derived by forcing an amplifier which supplies a signal to a limiter into oscillation at the intermediate frequency during those periods of reception where the broadcast signal amplitude falls below a minimum level. Referring more particularly to FIG. 3, a signal from an intermediate frequency amplifier 10 is derived by conventional superheterodyne techniques and is coupled to capacitor 27 and resistor 28 to a common emitter amplifier 33. Amplifier 33 known to those skilled in the art has associated therewith a biasing network 30 for providing the typical class A operation of the amplifier. The amplifier typically has a gain of 10 and the output thereof is capacitively coupled to a feed resistor 37. Feed resistor 37 couples the amplified IF signal to two back to back diodes 39 whereby the signal is limited in amplitude to the forward bias voltage of each of the diodes 39 which is typically 0.6 volts. The limited signal is thereafter applied to IF transformer 40 known to those skilled in the art having a tuned band pass characteristic centered at approximately the intermediate frequency. IF transformer 40 will provide a intermediate frequency signal limited in amplitude to a second amplifier limiter circuit 65. Amplifier circuit 65 amplifies the signal with the standard common emitter amplifier 66, and thereafter limits it with two back to back diodes 68. A transformer 69 also tuned to the intermediate frequency signal supplies the limited intermediate frequency signal in a known manner to a phase demodulator 70.

Phase demodulator 70 is a conventional frequency discriminator 83 having a deemphasizing capacitor 84. The deemphasizing point is selected to be in the neighborhood of 20 to 30 cycles whereby the discriminator acts more nearly as a phase detector rather than a frequency modulation detector. Transformer 80 provides inter stage coupling for the discriminator 83 and is similarly tuned to have a band pass characteristic centered around the intermediate frequency.

The output signal from the phase demodulator 70 is applied through a coupling capacitor 90 to a two stage common emitter amplifier 93 biased to provide class A operation whereby a linear, proportional L−R signal is produced which may be combined with a L+R signal in a known manner.

The substitute signal for the apparatus of FIG. 3 is derived by forcing amplifier 33 into oscillation during those periods when the broadcast signal has an amplitude below a predetermined minimum.

The oscillation of amplifier 33 is effected by supplying a feedback signal through capacitor 43 and resistor 45 to the base transistor 44 which comprises an attentuator 41. During periods when the intermediate frequency signal having an adequate amplitude is being received, detector 51 maintains transistor 44 in a non-conducting state. At the time a minimum amplitude intermediate frequency signal is detected by threshold detector 51, transistor 44 will supply the feedback signal in amplified form to the base of the transistor comprising the common emitter amplifier 33. Transistor 44 when enabled by the threshold detector 51 amplifies the feedback signal and provides phase inversion thereof, such that the signal will force transistor amplifier 33 into oscillation at the intermediate frequency. The collector output circuit of transistor 44 is similarly tuned with an intermediate frequency transformer 45 to ensure that the feedback signal has a proper phase and amplitude at the frequency of interest for forcing amplifier 33 into oscillation.

the metering jet until it is floated centered in the jet, leaving the entire bleed hole opened. As a result the amount of both fuel and bleed air increases to maintain the bleed sensitivity constant.

During the high air-intake operation the metering needle tends to vibrate due to the high revolution of the engine. However, since it is separated by the gap from the metering jet, they do not strike against each other, thus preventing wear of these components. This helps prevent the variation in the proportion between bleed air and fuel flow that would otherwise result from the change in the effective jet opening and therefore the bleed sensitivity can be maintained constant.

In summary this invention has the advantages of preventing the wear of the metering needle, maintaining the bleed sensitivity throughout the entire operating condition from the low air-intake region to the high air-intake region, and increasing the amount of fuel delivery during the cold operation by controlling the amount of the air bleed.

What is claimed is:

1. A variable venturi carburetor comprising: a suction chamber provided to one side of the venturi; a suction piston slidably inserted in the suction chamber; a biasing spring installed in a needle holder provided in the suction piston head; a metering needle held and biased by the biasing spring in the needle holder, the metering needle being loosely inserted through a main nozzle adapted to pass fuel and bleed air provided in the other side of the venturi opposite to the suction piston and through the metering jet adjacent to the main nozzle in such a manner that the needle can be brought into contact with the metering jet; a well into and from which the front end of the metering needle is made to advance or retract, the well having a large-bore portion and a small-bore portion; and an expanded portion formed at the front end of the metering needle, the expanded portion being sized so that it engages with the small-bore portion when the needle is retracted and is loosely contained in the large-bore portion when advanced; whereby during the low air-intake operating condition the metering needle is urged by the biasing spring to press against the metering jet and during the high air-intake operating condition it is floated centered in the metering jet, thus controlling the quantity of bleed air.

2. A variable venturi carburetor as set forth in claim 1, wherein the metering needle is inclined by the biasing spring provided in the needle holder in the suction piston head.

3. A variable venturi carburetor as set forth in claim 2, wherein the biasing spring is a leaf spring.

4. A variable venturi carburetor as set forth in claim 2, wherein the biasing spring is a coil spring which urges a flange fixed to the metering needle to abut against a projection of the control plate in the needle holder.

5. A variable venturi carburetor as set forth in any of claims 1 through 4, wherein the expanded portion of the metering needle is formed integral with the needle.

6. A variable venturi carburetor as set forth in claim 5, wherein the expanded portion of the metering needle is formed into a global shape.

7. A variable venturi carburetor as set forth in claim 5, wherein the expanded portion of the metering needle is shaped like a plate.

8. A variable venturi carburetor as set forth in claim 5, wherein the diameter of the expanded portion of the metering needle is slightly smaller than the inner diameter of the metering jet.

9. A variable venturi carburetor as set forth in any of claims 1 through 4, wherein the expanded portion of the metering needle is formed independently of the metering needle and then is fixed to the needle.

* * * * *